US006247407B1

(12) United States Patent
Hartmann et al.

(10) Patent No.: US 6,247,407 B1
(45) Date of Patent: Jun. 19, 2001

(54) PRINTING PRESS HAVING MOTOR WITH AN EXTERNAL ROTOR

(75) Inventors: Klaus Hartmann, Schriesheim; Michael Krüger, Edingen-Neckarhausen; Bernhard Wagensommer, Gaiberg, all of (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/364,899

(22) Filed: Aug. 2, 1999

(30) Foreign Application Priority Data

Jul. 31, 1998 (DE) ..... 198 34 658

(51) Int. Cl.[7] ..... B41F 13/008

(52) U.S. Cl. ..... 101/480; 101/216; 310/83; 310/67 R

(58) Field of Search ..... 101/216, 480, 101/494; 310/67 R, 83

(56) References Cited

U.S. PATENT DOCUMENTS 5,003,874 * 4/1991 Junghans ..... 101/348
5,524,805 * 6/1996 Shiba et al. ..... 101/425
5,651,312 * 7/1997 Borghesan ..... 101/216
5,704,288 1/1998 John ..... 101/216
5,711,221 1/1998 Compera et al. ..... 101/375
5,832,821 * 11/1998 Petersen et al. ..... 101/216

FOREIGN PATENT DOCUMENTS

2924616 * 1/1981 (DE) .
4138479 * 6/1993 (DE) .
195 30 283 A1 10/1996 (DE) .
195 21 827 A1 12/1996 (DE) .

OTHER PUBLICATIONS

Patent Abstracts of Japan No. 57–84853 A (Ijiyuin), dated May 27, 1982.

* cited by examiner

*Primary Examiner*—Daniel J. Colilla
(74) *Attorney, Agent, or Firm*—Herbert L. Lerner; Laurence A. Greenberg; Werner H. Stemer

(57) ABSTRACT

A printing press drive system includes at least one drive having a motor with an external rotor equipped with permanent magnets, the one drive being assigned to at least one cylinder of the printing press for driving the cylinder, and with a stator provided with windings and firmly fixed to the side panel of the printing press, at least part of the drive system being implemented via a gear train, and the rotor having a gear rim at a perimeter thereof.

18 Claims, 6 Drawing Sheets

PRINTING PRESS HAVING MOTOR WITH AN EXTERNAL ROTOR

BACKGROUND OF THE INVENTION

1. Field of the Invention

The invention relates to a printing press drive system having at least one drive with an external-rotor motor, the rotor thereof being equipped with permanent magnets and assigned to at least one cylinder of the printing press for the drive of the one cylinder, the stator of the external-rotor motor containing the windings and being firmly connected to a side panel of the printing press.

Printing press drive systems heretofore known in the prior art are formed of a closed gear train at the drive side of the printing press, the gear train being driven by a drive motor via a reduction gear and a belt drive. In this regard, high torques must be transmitted over an input pinion, a corresponding outlay being necessary with very massive gearwheels. In addition, the drive motor requires considerable space, and high tension forces of the drive belt must be taken up by bearings. Belt disturbances result in impairment of the torque quality which can in turn reduce printing quality. Because the power is led in over the central pinion, this must take up the entire drive torque for the press. The high forces are a problem particularly for presses with many printing units, especially for presses with six to eight or more printing units which are necessary when special inks have to be used.

In order to remedy these problems, a drive system of the type mentioned at the introduction hereto was proposed in the published German Patent Document DE 195 30 283 A1 in which the gear train is replaced by individual drives. One of the proposed individual drives provides an external-rotor motor having a stator fixed to the inside of the side panel of the printing press. This stator lies inside the cylinder, and the rotor is connected with the inside surface of the cylinder. In this way it is possible to dispense with a gear train and central drive motor and thus avoid the foregoing problems associated therewith.

A disadvantage of this attempted solution is that the angular coordination of the cylinders is controlled only electronically. In the case of a malfunction, for example due to a power interruption, the angular coordination is lost and there is a danger of a collision of the gripper bars. A further disadvantage of this attempted solution is that the cylinders no longer have any free shaft ends at the drive side of the printing press. Thus, it is not possible to provide auxiliary gearwheels for preventing the aforementioned danger of collision, nor to provide sensors, tachometers or brakes.

It is also impossible to drive further cylinders or rollers from the individual drives. Thus a large number of separate drives are necessary, although fewer drives—often only one drive per printing unit—would represent an ideal solution. Waste heat from the motor fitted inside the cylinder is an additional problem. This type of waste heat interferes with the printing process for many cylinders, for example plate cylinders, blanket cylinders or impression cylinders.

2. Summary of the Invention

It is accordingly an object of the invention, therefore, to provide a printing press drive system that avoids the disadvantages of drive systems or drives of the prior art and the disadvantages of the proposed individual drives, and which, in particular, reduces the high torques and, thereby, represents a simple, efficient and functionally reliable concept which saves space and material.

With the foregoing and other objects in view, there is provided, in accordance with the invention, a printing press drive system comprising at least one drive having a motor with an external rotor equipped with permanent magnets, the one drive being assigned to at least one cylinder of the printing press for driving the cylinder, and with a stator provided with windings and firmly fixed to the side panel of the printing press, at least part of the drive system being implemented via a gear train, and the rotor having a gear rim at a perimeter thereof.

In accordance with another feature of the invention, the rotor is firmly connected to the cylinder.

In accordance with a further feature of the invention, the printing press includes additional drives with respective external rotor-motors, and the printing press has a plurality of printing units, each of the printing units having at least one of the drives with an external-rotor motor assigned thereto.

In accordance with an added feature of the invention, the at least one drive is assigned to a cylinder so that it is separated from cylinders having the greatest power demand through as few power transmission locations as possible.

In accordance with an additional feature of the invention, the stator is fixed directly to the outside of the side panel of the printing press.

In accordance with yet another feature of the invention, the rotor is connected directly to a cylinder shaft and has the shape of a pot embracing the stator from the outside.

In accordance with yet a further feature of the invention, the rotor is formed of high-energy magnetic materials with a minimum possible thickness in a circumferential region thereof.

In accordance with yet an added feature of the invention, the gear rim is supported on the rotor so as to enable the gear rim to be rotated and fixed in position.

In accordance with yet an additional feature of the invention, the printing press drive system includes a sensor assigned to the gear rim, the gear rim having gear teeth serving for the sensor as markings for determining the angular position of an appertaining cylinder.

In accordance with still another feature of the invention, the rotor has a braking surface disposed thereon, and a brake is assigned to the rotor.

In accordance with still a further feature of the invention, the gear rim is directly received in the gear train.

In accordance with still an added feature of the invention, the printing press has a plurality of cylinders, and the gear rim serves as a driving part of a compact gear transmission system for driving the cylinders.

In accordance with another feature of the invention, the compact gear transmission system is a planetary gear train.

In accordance with an alternate feature of the invention, the compact gear transmission system is a cyclic gear train.

In accordance with a further alternate feature of the invention, the compact gear transmission system is a harmonic drive gear train.

In accordance with an added alternate feature of the invention, the compact gear transmission system is a spur gear train.

In accordance with an additional feature of the invention, the printing press drive system includes a flowing medium for cooling the stator.

In accordance with a concomitant feature of the invention, the printing press drive system includes a controller for discontinuously feeding power to at least one of the drives in a manner for counteracting a generation of vibrations due to discontinuous power consumption.

The invention makes it possible to avoid both the disadvantages of drives of the prior art and the disadvantages of the individual drives proposed in the published German Patent Document DE 195 30 283 A1. In particular, the torques arising in the gearwheels are considerably reduced, so that they and the bearings can be made smaller, thereby ecomizing on material, costs and space requirements. The particular advantage is that the drives can be arranged where high torques are necessary. This means either a direct disposition on the cylinder for which a high torque is necessary or in the vicinity of the cylinders for which high torques are necessary. This arrangement also makes it possible to avoid the transmission of high torques over many gearwheels with many transfer positions. An example would be a desirable central input of power to the impression cylinder. This advantage is enjoyed even if the printing press has only a single printing unit and is provided with only one drive of the type according to the invention. As a result, the transmission of the torques no longer needs to go through the entire gear train but can take place in all directions from one or more central positions. For example, the torques from the impression cylinder drive can go, on the one hand, to the gearwheels of the blanket cylinder and the plate cylinder, and the rollers of the inking unit and dampening unit and, on the other hand, to the transmission drums or to the feeder and the delivery.

The advantage of the invention is naturally especially relevant for printing presses with many printing units, because, in such a case, a single drive results in particularly high torques. In contrast with the proposal of the published German Patent Document DE 195 30 283 A1, the concept according to the invention does not require that a separate drive be assigned to every cylinder, every transmission drum, roller, gripper actuation or any other element that has to be driven. Although the different drives are implemented over the gearwheels of the gear train, the separated arrangement thereof means that power input is optimized in comparison with the gear train of the prior art. Due to the presence of the gear train, a collision of gripper bars is also impossible because the angular coordination of the cylinders—in this case of the transmission drums and the impression cylinder—is mechanically secured through the gearwheels. Naturally, this security is necessary only where there is a danger of collision, i.e., for all cylinders, including the transmission drums, with protruding elements such as grippers at the perimeter thereof.

As a result of the invention, it is also possible to use the free shaft ends at which sensors, tachometers or brakes can be arranged. The arrangement of the windings outside the side panel separates this waste heat-producing component from the printing process so that the latter is not disturbed and the waste heat can be disposed of easily. Also, the space inside the cylinder is available for other components. Because the motors are constructed so that the internally located stator contains the windings, the rotor containing the permanent magnets can be formed as a relatively thin cylindrical ring. The result is a small separation between the air gap of the electric motor and the power transmission through the gear rim, as a result of which, a greater transmission lever arm is available than if the windings are arranged in the outer part. Because these forces are transferred directly to the gear rim, the bearings of these drives are also relieved. The drives can be formed both as synchronous and as asynchronous motors.

In an advantageous embodiment of the invention, the rotor of a drive is firmly attached to a cylinder. In this way, the power of the electric motor is tranmitted directly to a cylinder. This is especially advantageous for high torques, because it is then unnecessary to construct the gearwheels for transmission of the power. It is naturally also possible to arrange a drive outside the cylinder, in which regard it is useful, however, to implement this arrangement at a location in the printing unit at which, through the power input, the transmission of large torques over several gearwheels is avoided.

An advantageous embodiment provides that at least one drive with an external-rotor motor be assigned to every printing unit. In this way, every printing unit with its supply of driving power forms an entity and it is possible to construct printing presses with any required number of printing units by stringing these entities together. Increasing the number of printing units in this way does not increase the torques produced, with the result that the gearwheels can be dimensioned independently of the number of printing units.

It is advantage to arrange that at least one of the drives is assigned to such a cylinder that it is separated from the cylinders with the greatest power requirement by as few power transmission or transfer positions as possible. This means that the drive is either assigned directly to the cylinder with the greatest power requirement or is at least separated by no more than one transmission or transfer position.

A robust arrangement that is simple to assemble provides for the stator to be fixed directly to the outside of the side panel of the printing press. The rotor embraces this stator and serves with its gear rim as the driving gearwheel of the gear train. It can be connected directly to a cylinder shaft and can be shaped like a pot embracing the stator from the outside. A simple assembly is thus possible through form-locking and screw connections. In this regard, it is noted that a form-locking connection is one which connects two elements together due to the shape of the elements themselves, as opposed to a force-locking connection, which locks the elements together by force external to the elements.

The magnetic forces can be increased even further by using high-energy magnetic materials. In this way, even higher moments of force can be generated and transmitted to the gear rim.

It is advantageous for the gear rim to be supported on the rotor in a way which enables it to be rotated and fixed in place. This enables an adjustment to be made in order to set the angular alignment and thereby the register accuracy of the cylinder.

The gear rim can have a sensor allocated thereto which uses the gear teeth of the gear rim as markings for recording the angular position of the motor and the associated cylinder. This enables both the motor to be controlled and also the position of this cylinder to be determined directly without the need to provide and align any special markings.

It is also possible to arrange a braking surface on the rotor and allocate or assign a brake thereto. The brake can be provided both at the perimeter of the rotor and at the end face as a kind of disk brake.

The gear rim of the drive according to the invention can be engaged or received directly in the gear train. In this case, the gearwheel loading is reduced to values which are determined by the external load distribution. It is also possible for this gear rim to be a driving part of a compact gear transmission system which drives the cylinder. This compact gear transmission system can be a spur gear train, a planetary gear train, a cyclic gear train, a harmonic drive gear, or some other compact set of gears. In the case of a planetary gear train, the gear rim of the rotor can, for example, be provided as a sun gear.

The windings of a motor produce the most waste heat. Because they are arranged in the stator, it is possible to provide a cooling system with a flowing medium that is fed to and from the stator.

Because, besides the foregoing advantages, the drive has a direct effect and is very rigid, it is possible, in a simple way to arrange through a controller that at least one drive is fed power discontinuously so as to counteract the vibrations arising through a discontinuous power consumption. A discontinuous power consumption arises for example at the gripper bars which are actuated by cam disks. The discontinuous uptake of power through the cam disks generates vibrations which lead to noisy running of the printing press. If the power that is fed is discontinuously altered in a corresponding way, this generation of vibrations is compensated for, the effectiveness of this compensation being all the greater, the longer the transmission lever arms which makes the supplied power available.

Other features which are considered as characteristic for the invention are set forth in the appended claims.

Although the invention is illustrated and described herein as embodied in a printing press drive system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
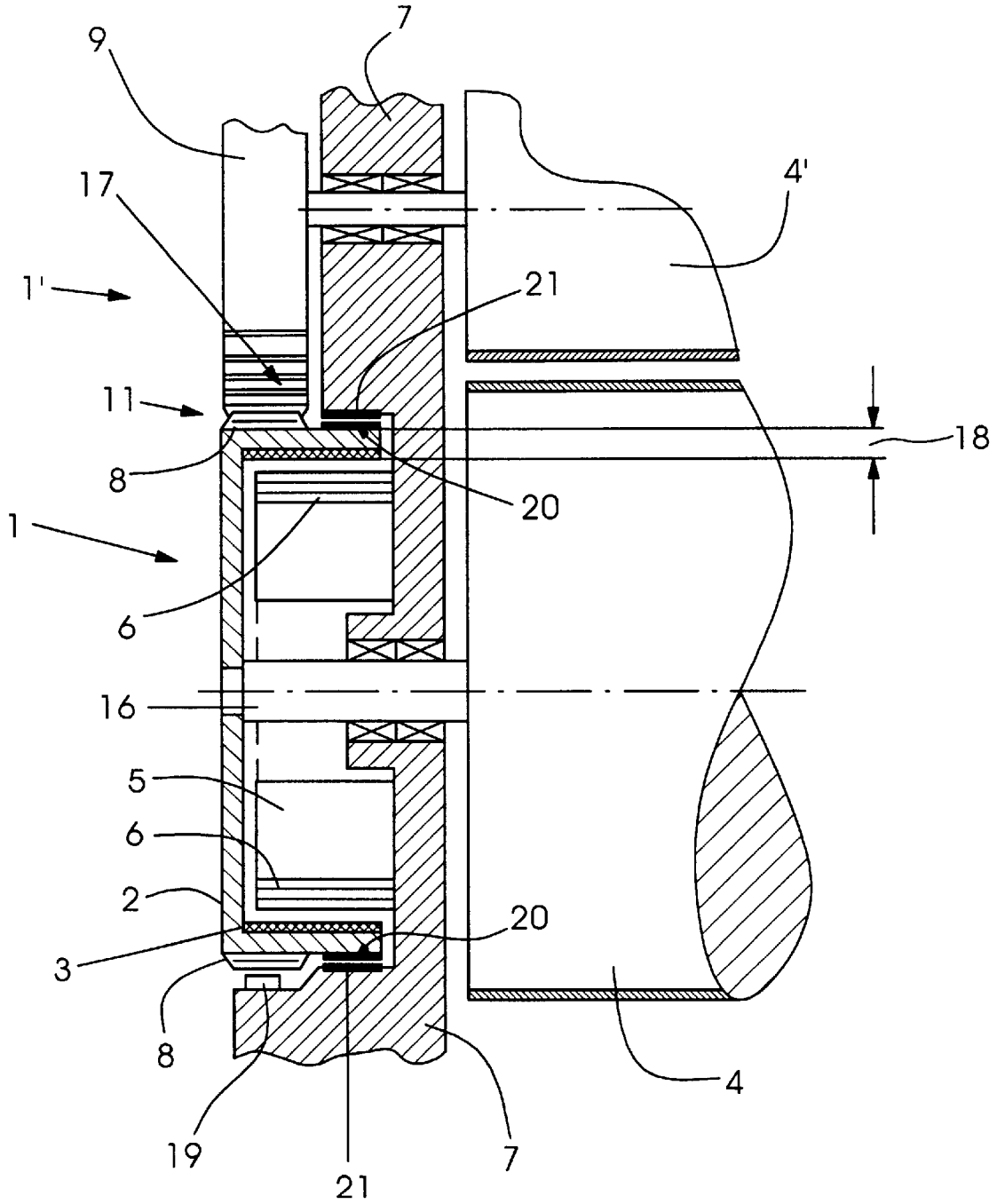
FIG. 1 is a fragmentary sectional view of an exemplary embodiment of a drive according to the invention.

Referring now to the drawings and, first, particularly to FIG. 1 thereof, there is shown therein an embodiment of the invention with a first cylinder 4 which is driven by a motorized drive 1 made up of a stator 5 having windings 6 and being fixed to a side panel 7 of the printing press. A cylinder shaft 16 of the cylinder 4 extends through the stator 5 and is connected at an end thereof to a pot-shaped rotor 2 which embraces the stator 5. Permanent magnets 3 are integrated in the cylindrical outer walls of the rotor 2, the surrounding or circumferential region 17 of the rotor 2 being able to be formed with a relatively small thickness 18, especially due to the use of high-energy magnetic materials,. The effective range of the magnetic forces is thereby displaced outwards considerably, and a longer transmission lever arm for transfer of force is available thereto. The force generated is transmitted directly to the cylinder 4 over the cylinder shaft 16, and the cylinder 4 is driven thereby. In addition, the rotor 2 is provided at the perimeter thereof with a gear rim 8 that conveys the forces, at power transfer locations 11, to one or more drive gearwheels 9 in order, in this manner, to enable further cylinders 4' to be driven. The cylinders 4 and 4' to be driven can, of course, also be drums or rollers. In this way, it is possible to arrange drives 1 with a respective motor at the positions of greatest power requirement within a gear train and to assign gearwheel drives 1' without a motor to these drives 1 with external-rotor motors. Thus, the gear train of the printing press is retained as such and the power input is simply transferred to the locations of greatest power demand, leading to the aforementioned advantages.

At the gear rim 8, a sensor 19 is also provided which as a transducer records the angular position of the cylinder 4, for which the teeth serve as markings. In addition, the rotor 2 carries a braking surface 20 that is gripped by the brakes 21.

Figure 2:
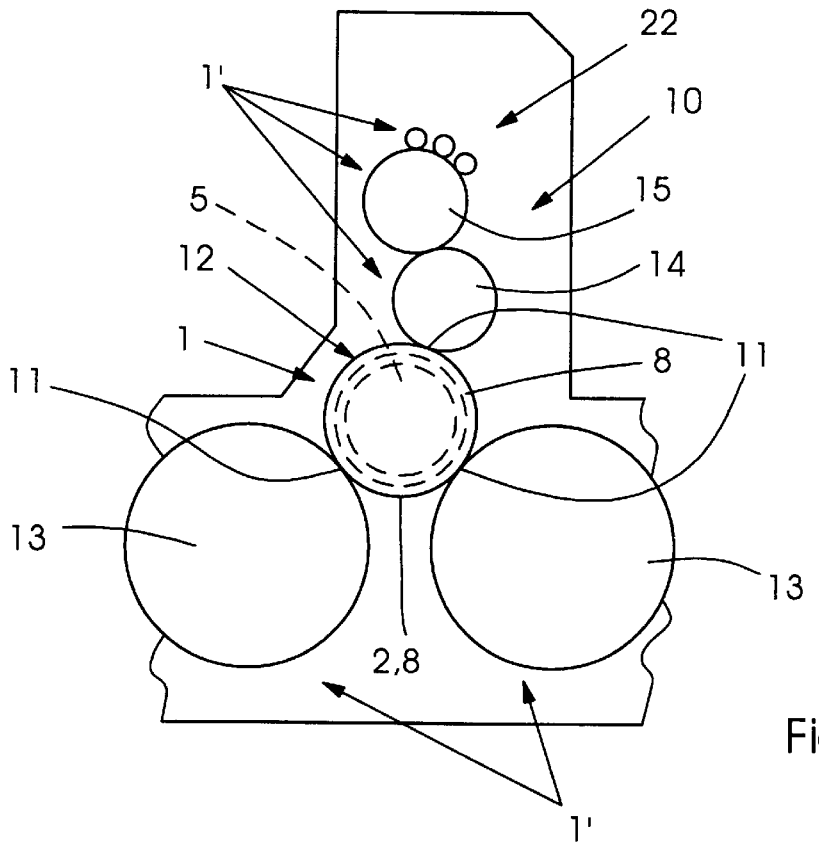
FIG. 2 is a diagrammatic side elevational view of a printing unit incorporating the drive according to the invention.

FIG. 2 is a diagrammatic view of the arrangement of drives 1 and 1' in a printing unit 10. In this regard, a printing press can have one printing unit 10 or many printing units 10, with transfer drums 13 serving to transport the sheets from one printing unit to the other. FIG. 2 diagrammatically illustrates the arrangement of the transfer drums 13, an impression cylinder 12, a blanket cylinder 14, a plate cylinder 15 and an inking unit 22. In the illustrated exemplary embodiment, the drive 1 with the external-rotor motor is located in the gearwheel of the impression cylinder 12 which is thus driven directly. From the gear rim 8 of this drive 1, the power is transmitted at locations 11 to the gearwheels of the transfer drums 13 and the blanket cylinder 14. Power is transmitted further through gearwheels from the blanket cylinder 14 to the plate cylinder 15, and possibly also to the inking unit 22 or a non-illustrated dampening unit. The central arrangement of the drive 1 enables the torques to be transmitted either directly, as in the case of the impression cylinder 12, or over short transmission paths to the other cylinders 13, 14 and 15.

Figure 3:
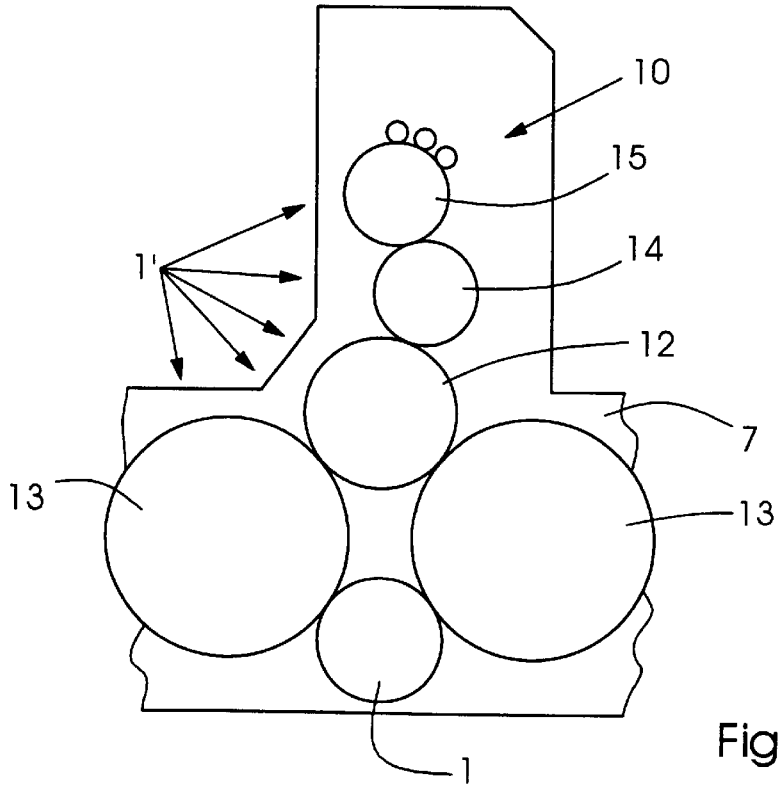
FIG. 3 is a view like that of FIG. 2, showing an alternative drive arrangement.

FIG. 3 shows an alternative arrangement in which the drive 1 with an external-rotor motor is not assigned directly to a cylinder but is attached separately to the side panel 7 in order to transmit the torques to the gearwheels of the transfer drums 13 which transmit these torques further to the remaining cylinders 12, 14 and 15. Thus, the drive 1 is part of a spur gear drive.

These arrangements are naturally only examples; it is also possible to provide several drives 1 with a respective motor in a single printing unit or to equip only a part or some of the printing units 10 with such drives.

FIGS. 4–9 illustrate preferred embodiments of the invention. The same parts are indicated by the same reference numerals in all the figures and therefore the parts have been described only with reference to FIGS. 1–3.

Figure 4:
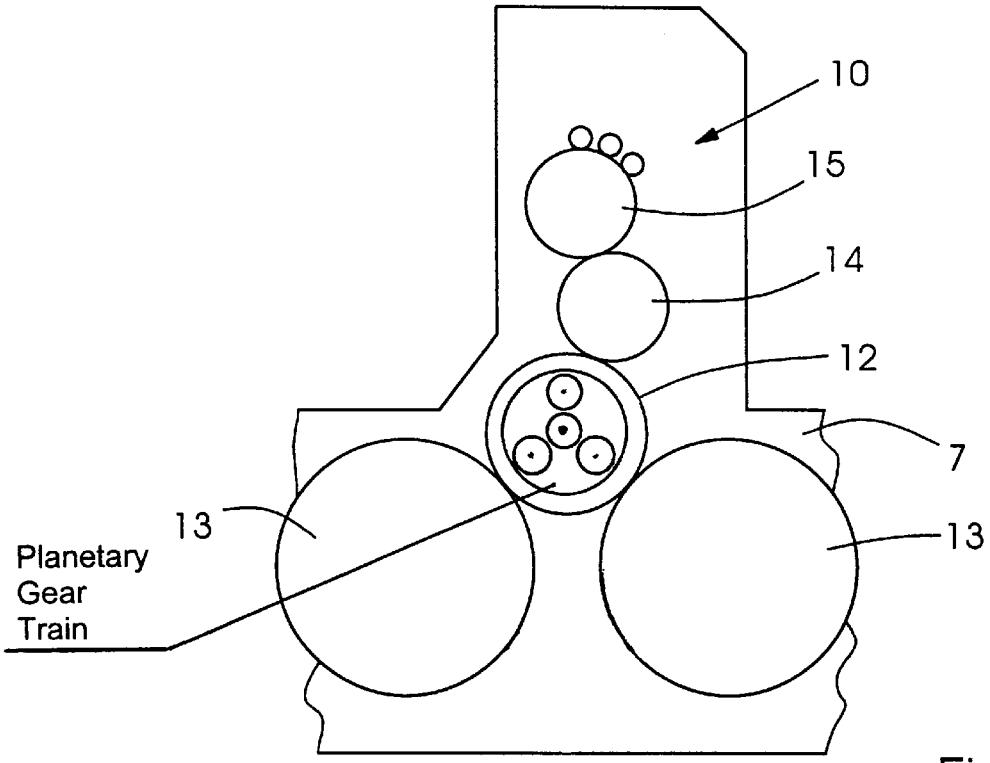
FIG. 4 is a diagrammatic side elevational view of a printing unit using a planetary drive.
Figure 5:
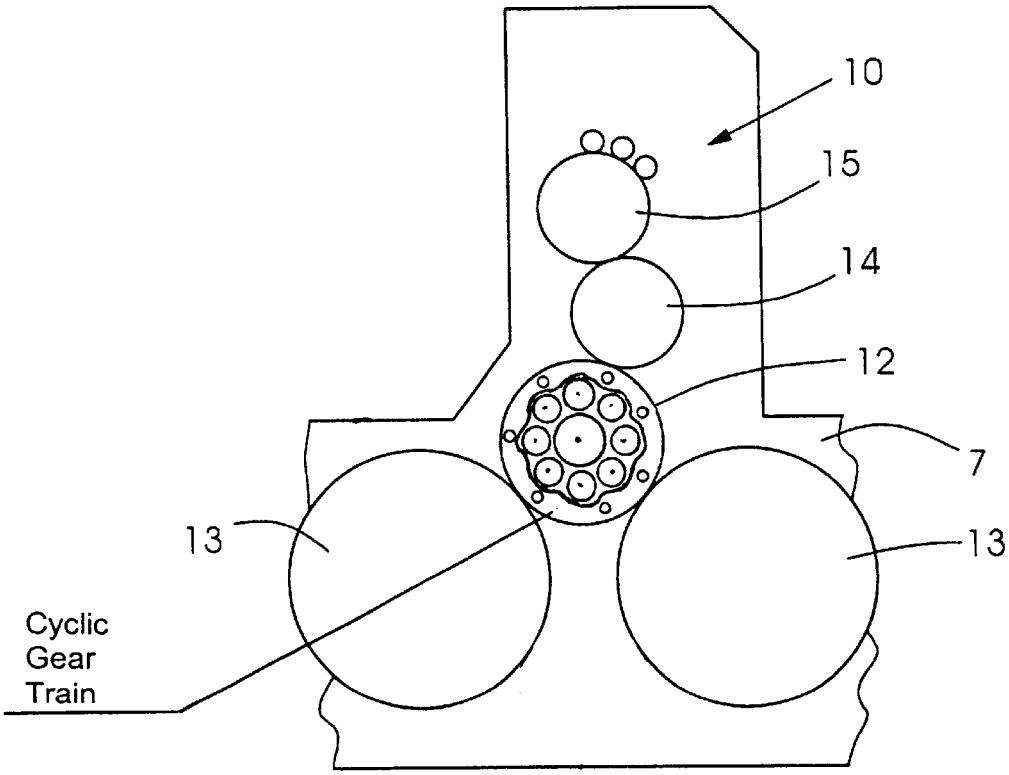
FIG. 5 is a diagrammatic side elevational view of a printing unit using a cyclic gear train.
Figure 6:
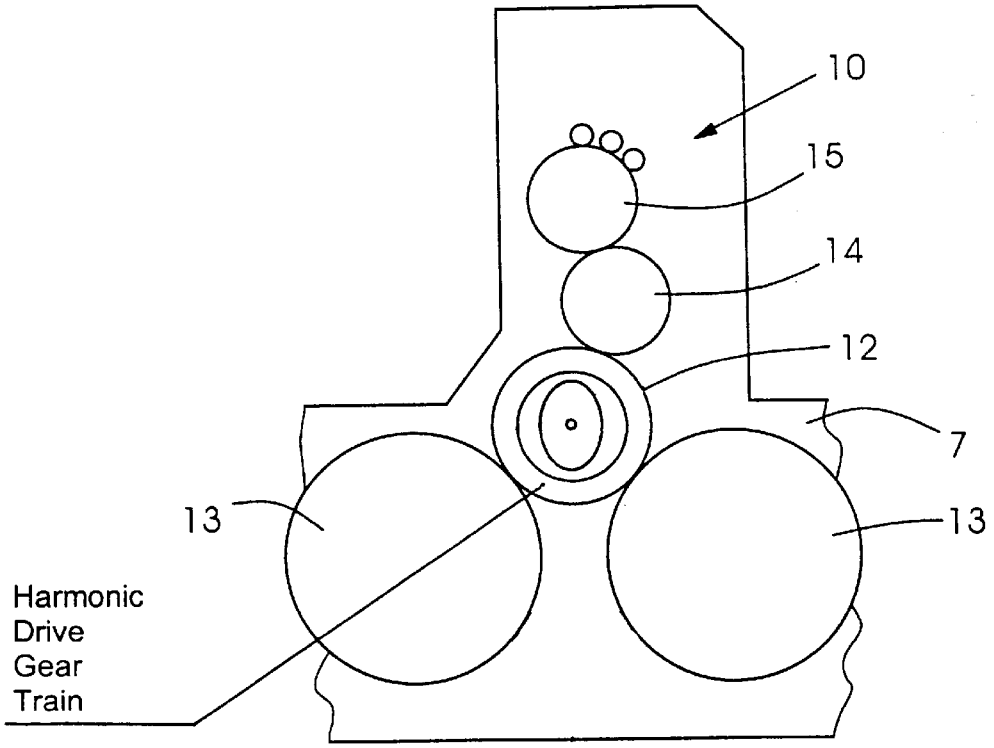
FIG. 6 is a diagrammatic side elevational view of a printing unit using a harmonic drive gear train.
Figure 7:
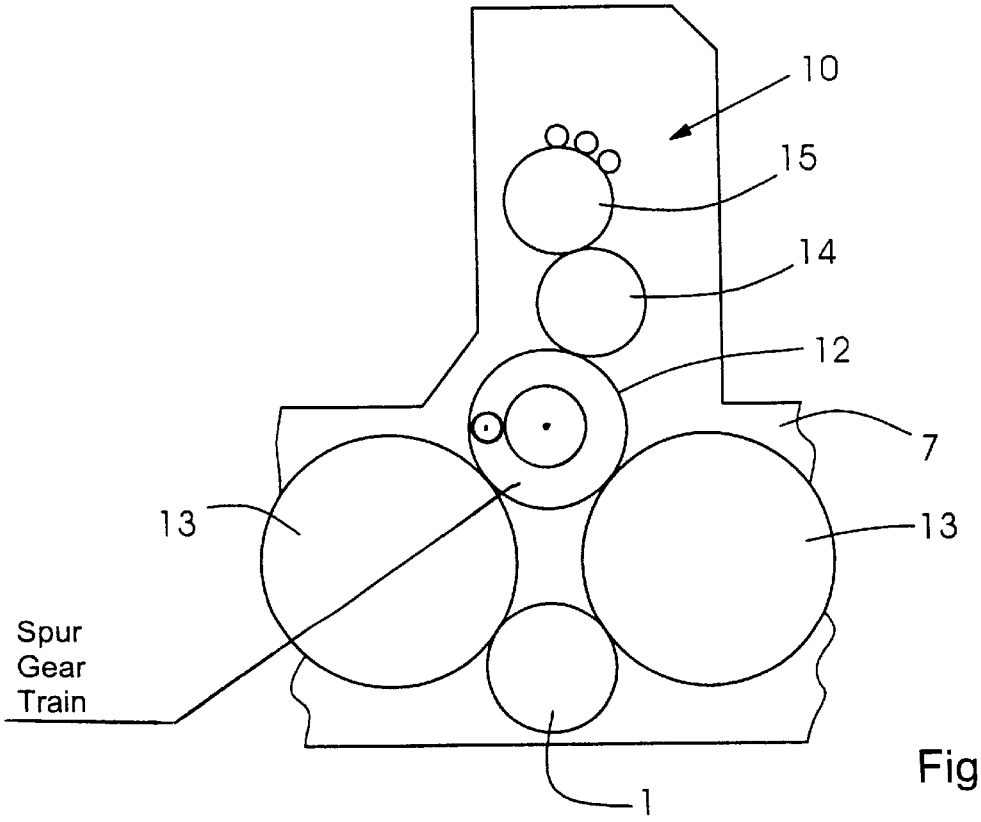
FIG. 7 is a diagrammatic side elevational view of a printing unit using a spur gear train.

FIG. 4 illustrates a printing unit that uses a planetary drive. FIG. 5 shows a printing unit with a cyclic gear train. FIG. 6 is a diagrammatic side elevational view of a printing unit using a harmonic drive gear train, and FIG. 7 is a diagrammatic side elevational view of a printing unit using a spur gear train. The basic principles of planetary drives, cyclic gear trains, harmonic drive gear trains, and spur gear trains are known and need not be explained in detail.

Figure 8:
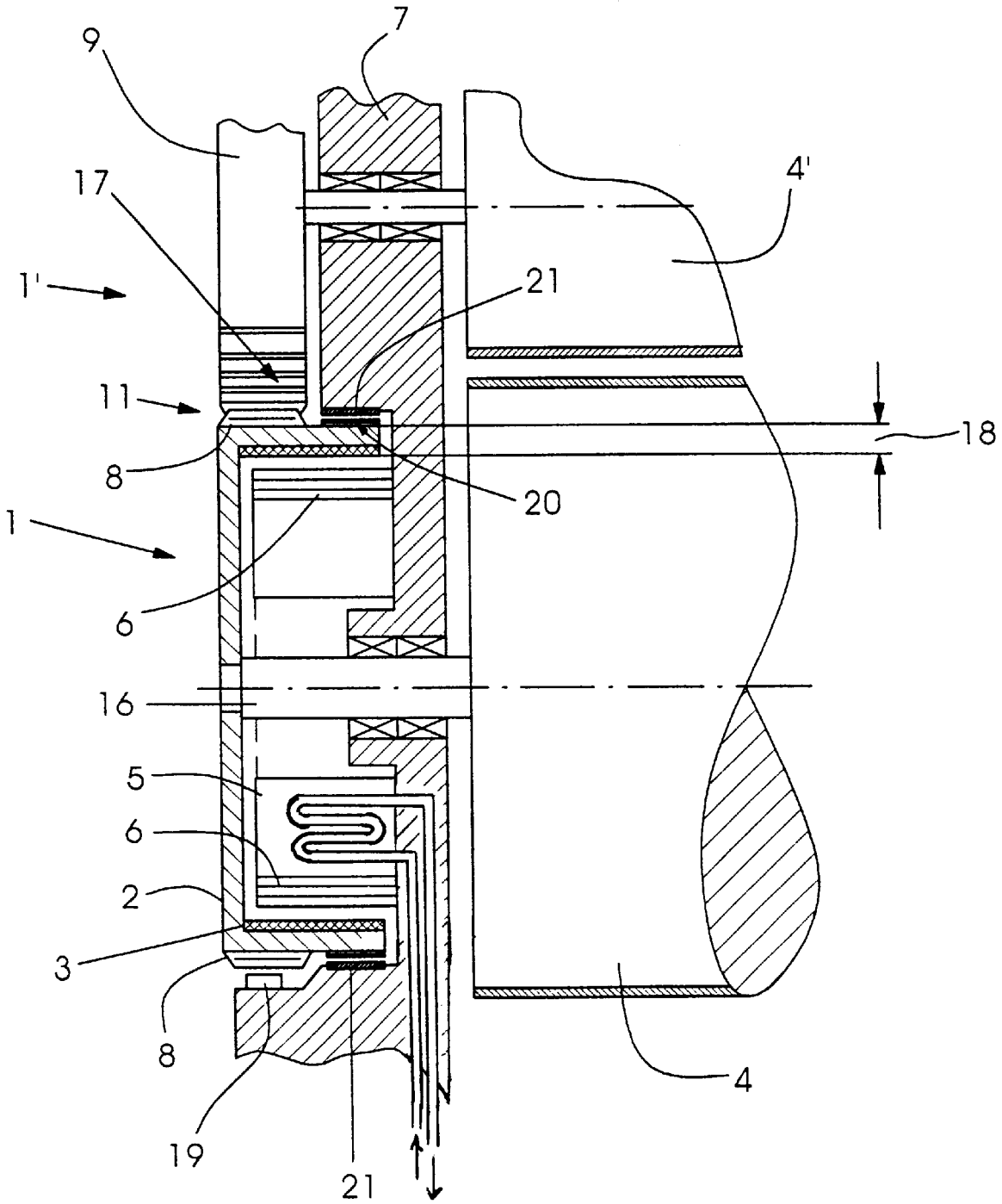
FIG. 8 is a fragmentary sectional view of an exemplary embodiment of a drive using a flowing medium for cooling the stator.

FIG. 8 is a fragmentary sectional view of an exemplary embodiment of a drive using a flowing medium for cooling purposes. The flow medium and its flow direction is indicated by arrows in FIG. 8. The flow medium runs through the stator 5 in order to cool the stator 5.

Figure 9:
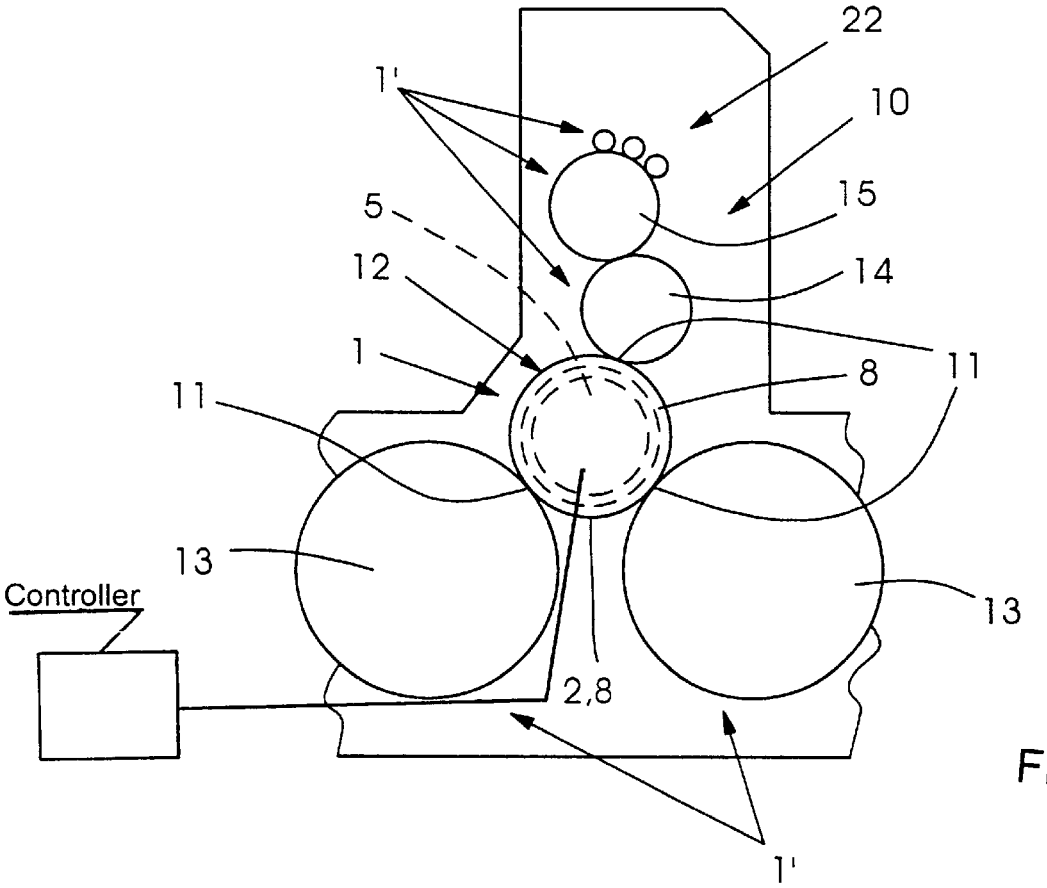
FIG. 9 is a diagrammatic side elevational view of a printing unit including a controller.

FIG. 9 is a diagrammatic side elevational view of a printing unit including a controller. The controller is configured for discontinuously feeding power to at least one drive of the printing machine in order to counteract vibrations generated due to a discontinuous or changing power consumption of the drive.

We claim:

1. A printing press drive system comprising at least one drive having a motor with an external rotor equipped with permanent magnets, said one drive being assigned to at least one cylinder of a printing press for driving the cylinder, and with a stator provided with windings and firmly fixed to a side panel of the printing press, at least part of the drive system being implemented via a gear train, and said rotor having a gear rim at a perimeter thereof.

2. The printing press drive system according to claim 1, wherein said rotor is firmly connected to the cylinder.

3. The printing press drive system according to claim 1, including additional drives with respective external rotor-motors, and wherein the printing press has a plurality of printing units, each of the printing units having at least one of said drives with an external-rotor motor assigned thereto.

4. The printing press drive system according to claim 1, wherein said at least one drive is assigned to a cylinder so that it is separated from cylinders having the greatest power demand through as few power transmission locations as possible.

5. The printing press drive system according to claim 1, wherein said stator is fixed directly to the outside of the side panel of the printing press.

6. The printing press drive system according to claim 5, wherein said rotor is connected directly to a cylinder shaft and has the shape of a pot embracing said stator from the outside.

7. The printing press drive system according to claim 1, wherein said rotor is formed of high-energy magnetic materials with a minimum possible thickness in a circumferential region thereof.

8. The printing press drive system according to claim 1, wherein said gear rim is supported on said rotor so as to enable said gear rim to be rotated and fixed in position.

9. The printing press drive system according to claim 1, including a sensor assigned to said gear rim, said gear rim having gear teeth serving for said sensor as markings for determining the angular position of an appertaining cylinder.

10. The printing press drive system according to claim 1, wherein said rotor has a braking surface disposed thereon, and wherein a brake is assigned to said rotor.

11. The printing press drive system according to claim 1, wherein said gear rim is directly received in said gear train.

12. The printing press drive system according to claim 1, wherein the printing press has a plurality of cylinders, and said gear rim serves as a driving part of a compact gear transmission system for driving the cylinders.

13. The printing press drive system according to claim 12, wherein said compact gear transmission system is a planetary gear train.

14. The printing press drive system according to claim 12, wherein said compact gear transmission system is a cyclic gear train.

15. The printing press drive system according to claim 12, wherein said compact gear transmission system is a harmonic drive gear train.

16. The printing press drive system according to claim 12, where in said compact gear transmission system is a spur gear train.

17. The printing press drive system according to claim 1, including a flowing medium for cooling said stator.

18. The printing press drive system according to claim 1, including a controller for discontinuously feeding power to at least one of said drives in a manner for counteracting a generation of vibrations due to discontinuous power consumption.

* * * * *